US008656856B1

(12) United States Patent
Morrow

(10) Patent No.: US 8,656,856 B1
(45) Date of Patent: Feb. 25, 2014

(54) COLLAPSIBLE PERSONAL CATAMARAN

(76) Inventor: James Q. Morrow, Chandler, AZ (US)

( * ) Notice: Subject to any disclaimer, the term of this patent is extended or adjusted under 35 U.S.C. 154(b) by 306 days.

(21) Appl. No.: 13/011,415

(22) Filed: Jan. 21, 2011

(51) Int. Cl.
*B63B 7/00* (2006.01)
*B63B 1/00* (2006.01)

(52) U.S. Cl.
USPC ..... 114/354; 114/61.1

(58) Field of Classification Search
USPC ..... 114/343, 347, 352, 353, 354, 355, 358, 114/361, 61.1, 61.22
See application file for complete search history.

(56) References Cited

U.S. PATENT DOCUMENTS 3,965,513 A * 6/1976 Horiuchi ..... 114/352
4,593,641 A * 6/1986 Adams et al. ..... 114/343
4,627,372 A * 12/1986 Douglas, III ..... 114/61.2
4,700,648 A * 10/1987 Trefethern et al. ..... 114/61.24
4,823,717 A * 4/1989 Roberson ..... 114/61.1
4,829,926 A * 5/1989 Voelkel ..... 114/61.22
2008/0236467 A1* 10/2008 Wyman ..... 114/61.1

* cited by examiner

*Primary Examiner* — Stephen Avila
*Assistant Examiner* — Andrew Polay
(74) *Attorney, Agent, or Firm* — Benjamin D. Tietgen; Quarles & Brady LLP

(57) ABSTRACT

A collapsible catamaran has twin rigid hulls attached by frame members to a platform that holds a rider. The hulls and platform are divided into sections to allow the hulls and platform to be disassembled and transported in a small space. The hulls are substantially hollow and have access ports that allow a rider to store buoyant materials or equipment inside the hulls. A motor mount is attached to the front platform and receives an electric motor that is configured to pull the catamaran through the water. A cover may be attached to the platform to provide shade to the rider. The cover may support one or more solar panels that collect electricity to power the motor. The parts may be combined in a kit, which allows the rider to assemble the components of the collapsible catamaran. The catamaran may then be assembled from and disassembled into the components before and after each use.

3 Claims, 10 Drawing Sheets

COLLAPSIBLE PERSONAL CATAMARAN

FIELD OF INVENTION

This invention relates to personal watercraft. This invention relates particularly to a collapsible personal catamaran with a rigid hull.

BACKGROUND

A personal watercraft is a vehicle designed to transport one or two riders over the surface of a pond, lake, river, ocean, or other body of water. Examples of personal watercraft include human-powered craft such as canoes, kayaks, and paddle boats; wind-powered craft such as sailboats; and motorized craft such as jetskis and fishing boats. The catamaran, which is a boat having two substantially identical hulls connected with a platform, may be human-powered, but are typically wind-powered or motorized. Catamarans are differentiated from other personal watercraft in that the platform keeps the riders relatively high above the surface of the water, and a dual-hull design provides a platform that is substantially more stable and resistant to tipping than that of a mono-hull design.

Despite their limited capacity of transporting only one or two people, personal catamarans have a large footprint when assembled. The smallest catamaran is still too heavy for one person to carry, and so large that it must be transported in a truck bed or on a trailer. It would be advantageous to have a catamaran that can be collapsed when not in use, so that a single rider can transport it between home and water without a truck or trailer. Known personal catamarans address this need with inflatable parts. Typically, the hulls are made of rubber or latex and can be inflated with air before use. Some inflatable catamarans further have an inflatable deck. The primary drawback of using inflatable parts is that the craft is no longer rigid. It therefore sits low in the water, is susceptible to gradual and rapid loss of air, and is easily damaged. Another problem with the inflatable design is that it has inferior aero- and fluid-dynamic characteristics to a rigid design because the hull walls are less resistant to the forces of air and water applied while the craft is in use. Additionally, on a rigid catamaran the hulls may be hollow, and may be used to store equipment such as food, water, and camping gear. On an inflatable catamaran, this storage space is lost because the hulls must be sealed to keep air in. A collapsible catamaran with rigid hulls is needed.

Therefore, it is an object of this invention to provide a collapsible personal catamaran with rigid components. It is a further object that the catamaran has a plurality of pontoons divided into sections for easy transport and storage. It is a further object that the catamaran can be transported inside a small car. Another object of this invention is to provide a kit for building a personal catamaran with rigid components that can be assembled and disassembled before and after use.

SUMMARY OF THE INVENTION

A personal catamaran is collapsible, in that it may be assembled and disassembled before and after each use, if desired. The catamaran has a plurality of substantially rigid hulls attached to each other by frame members. Each pontoon has between two and four sections which are attached with a watertight joint to form a substantially hollow pontoon. Each pontoon may have one or more access ports formed into the top, so that articles, such as buoyant materials or equipment, may be stored and kept dry in the pontoon. A platform is attached to the hulls by bolts driven through the frame members. The platform is substantially planar, and is divided into at least two sections. The platform is positioned above the pontoons, so that it is elevated from the water level during use. The platform receives one or more chairs for a user to sit upon. A motor mount is attached to the platform and is configured to receive a low-wattage or low-horsepower motor. Preferably, the motor mount is attached at the front of the platform, so that the motor pulls the catamaran through the water rather than pushing it. The platform may be further configured with additional mounts for a canopy or other cover, and for solar panels to power the motor.

In the preferred embodiment, the catamaran is provided in a kit containing the parts used to build the components of the catamaran, the components including the hull sections, frame members, platform, and motor mount, as well as assembly hardware. Preferably, the parts may be configured so that they are shipped to a builder in two boxes having a total of less than 10 cubic feet of volume. The components, built but not assembled into the catamaran, fit into a space of about 32 cubic feet. Fully assembled, the components form a catamaran with dimensions of about 100 inches long and 54 inches wide, with a platform height of about 20 inches from the bottoms of the hulls. The kit may further include a canopy or other cover that protects the rider from sun and rain, and may further receive one or more solar panels.

DETAILED DESCRIPTION OF THE INVENTION

Figure 1:
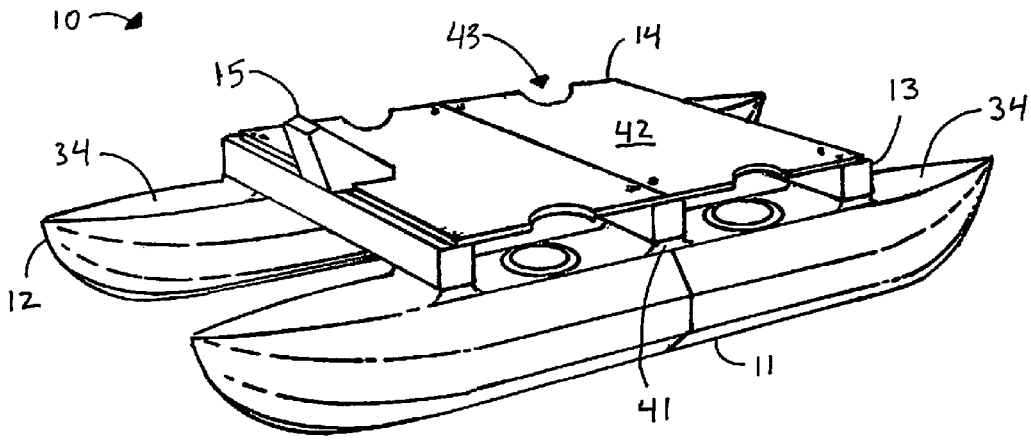
FIG. 1 is a front left perspective view of the preferred embodiment of the assembled catamaran.
Figure 2:
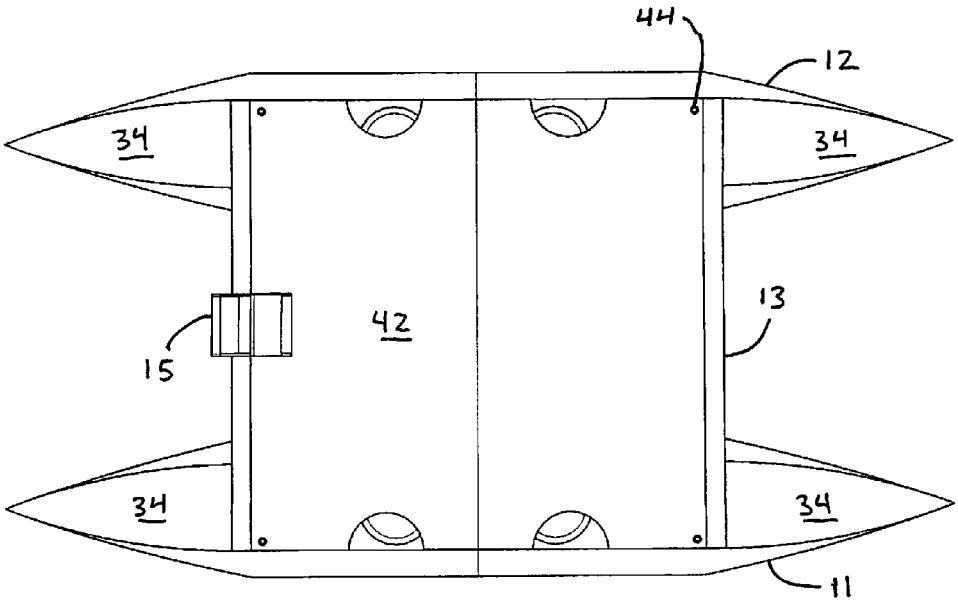
FIG. 2 is a top view of the catamaran of FIG. 1.
Figure 3:
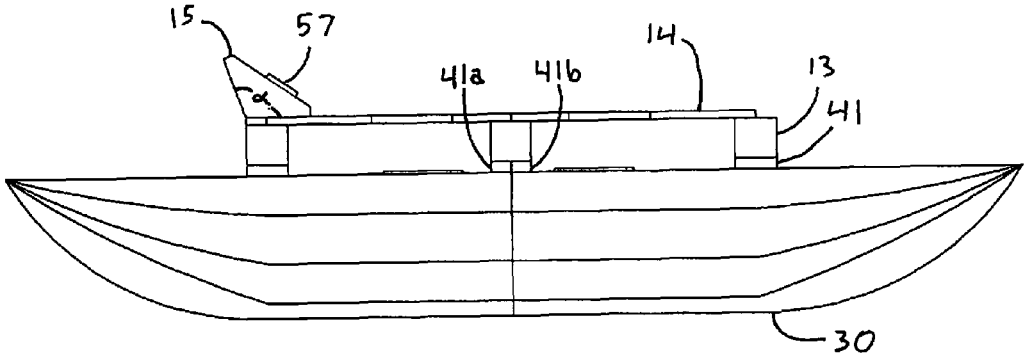
FIG. 3 is a left side view of the catamaran of FIG. 1.
Figure 4:
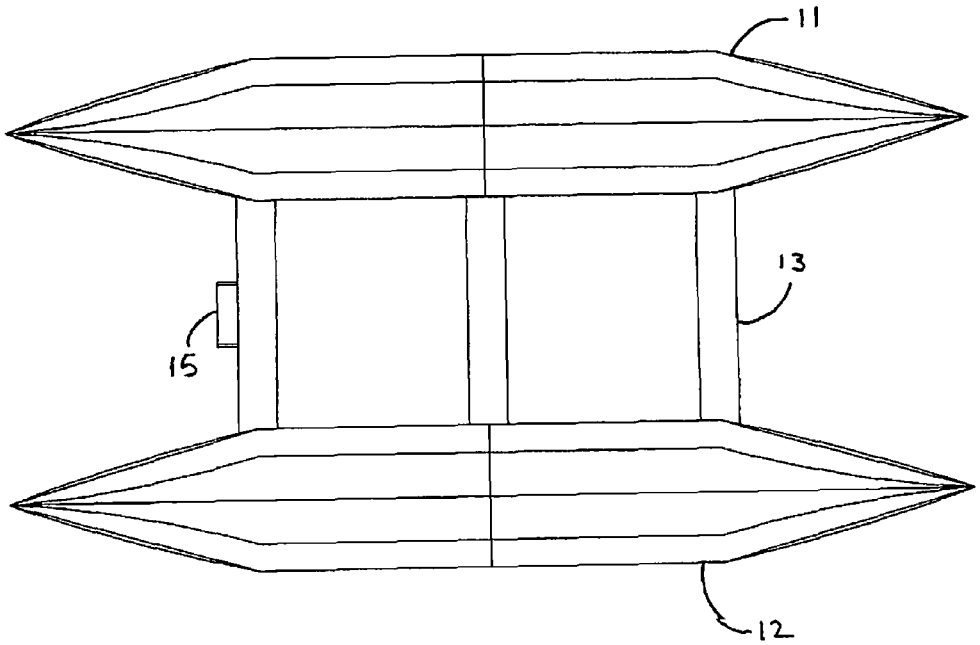
FIG. 4 is a bottom view of the catamaran of FIG. 1.

Referring to FIGS. 1-8, there is illustrated the preferred embodiment of the present invention designated generally as 10 which is a collapsible, rigid-hull personal catamaran. The catamaran 10, shown fully assembled in FIGS. 1-5 and exploded in FIG. 6, comprises at least two hulls; a three-hull trimaran embodiment may be constructed using the following description of the two-hull design. The catamaran 10 comprises a left hull 11 attached to a right hull 12 with one or more frame members 13, a platform 14 attached to the frame members 13, and a motor mount 15 attached to the platform 14 at the front of the platform 14. A motor, which may be any low-power electric propeller motor, such as a trolling motor, may be attached to the motor mount 15 such that the motor pulls the catamaran 10 forward. Alternatively, the catamaran may be human-powered.

The hulls 11, 12 are substantially rigid nautical floats, preferably pontoons, that are substantially hollow with thin, substantially rigid walls. A hull may be molded fiberglass, fiberglass sprayed over a core of plywood or foam, or cut and joined rigid planks made of wood, plastic, or another light-weight rigid material. Preferably, the hulls 11, 12 are made of plywood of between 0.125 and 0.5 inches thickness. The thickness of the plywood may depend on the scale of the catamaran and number of intended riders. For example, a 0.125-inch thick plywood is suitable for the preferred single-rider catamaran, while a 0.5-inch thick plywood may be needed for a wider catamaran designed for two riders. The plywood may be cut to the desired shape and arranged to form a tube, such as by using the kit assembly method described below. See FIGS. 1 and 7. The planks are preferably joined using the stitch-and-glue method, wherein a pair of planks is pulled into joint using a wire, and the inside of the joint is filleted with fiberglass or masking tape and epoxy. Alternative methods of creating a watertight joint between planks may also be used. In the preferred embodiment, the assembled plywood hulls 11, 12 are sheathed in fiberglass cloth and marine epoxy glue, using any application method known in watercraft construction.

The left hull 11 is preferably substantially identical to the right hull 12, and the bow and stern of each hull 11, 12 are preferably substantially identical, as in a canoe. The tops of the hulls 12, 13 comprise a substantially planar deck 34 configured to receive the frame members 13 for attachment as described below. The deck 34 preferably extends from the proximal, or bow end to the distal, or stern end of each hull 11, 12. In the preferred embodiment, the deck 34, and therefore each hull 11, 12, is 100 inches long.

Figure 5:
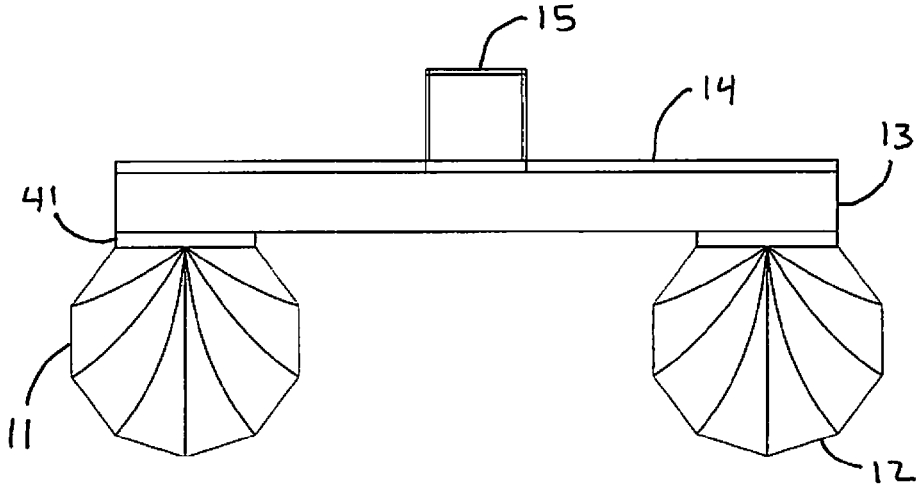
FIG. 5 is a front view of the catamaran of FIG. 1.

The widest part of each hull 11, 12 has a substantially uniform cross-section, which is polygonal or substantially circular. The cross-sectional shape may be characterized as a regular polygon or circle, except that the deck 34 flattens the regular shape at the top of the hull. For example, FIG. 5 illustrates the preferred cross-sectional shape of each hull 11, 12, which is a regular decagon that is flattened by the deck 34 so that the cross-sectional shape of the hulls 11, 12 only has nine sides. As shown, this imparts a hard chine on the hulls 11, 12, with the deck 34 being substantially parallel to the water-line. The hulls 11, 12 may have a single chine, multiple chines, or a rounded bottom. Preferably, the hulls 11, 12 are three-chine hulls, which is achieved using the illustrated flat-tened-decagon shape. This design imparts a substantially rounded shape upon the hulls 11, 12 while allowing one of the chines to serve as a keel 30, providing directional stability to the catamaran 10 as it moves through the water. The cross-sectional shape of the hulls 11, 12 may be uniform throughout the length of each hull 11, 12, so that the hull has a cylindrical or prism shape. Preferably, however, the bow and stern each taper to a point.

Each hull 11, 12 is divided into a plurality of sections that are separable from each other. See FIG. 6. In the preferred embodiment, the hulls 11, 12 are divided into two sections 60 at the midpoint of the hull. In an alternative embodiment, the hulls 11, 12 are divided into four sections. Dividing the hulls 11, 12 into sections allows them to be transported in vehicles that could not fit the assembled hull 11, 12. Further, the hull sections are far lighter than the assembled hull 11, 12. In the preferred embodiment, an assembled hull weighs about 34 pounds, while a section of the hull weighs about 17 pounds. The sections of a four-section hull weigh about 9 pounds each.

Figure 7:
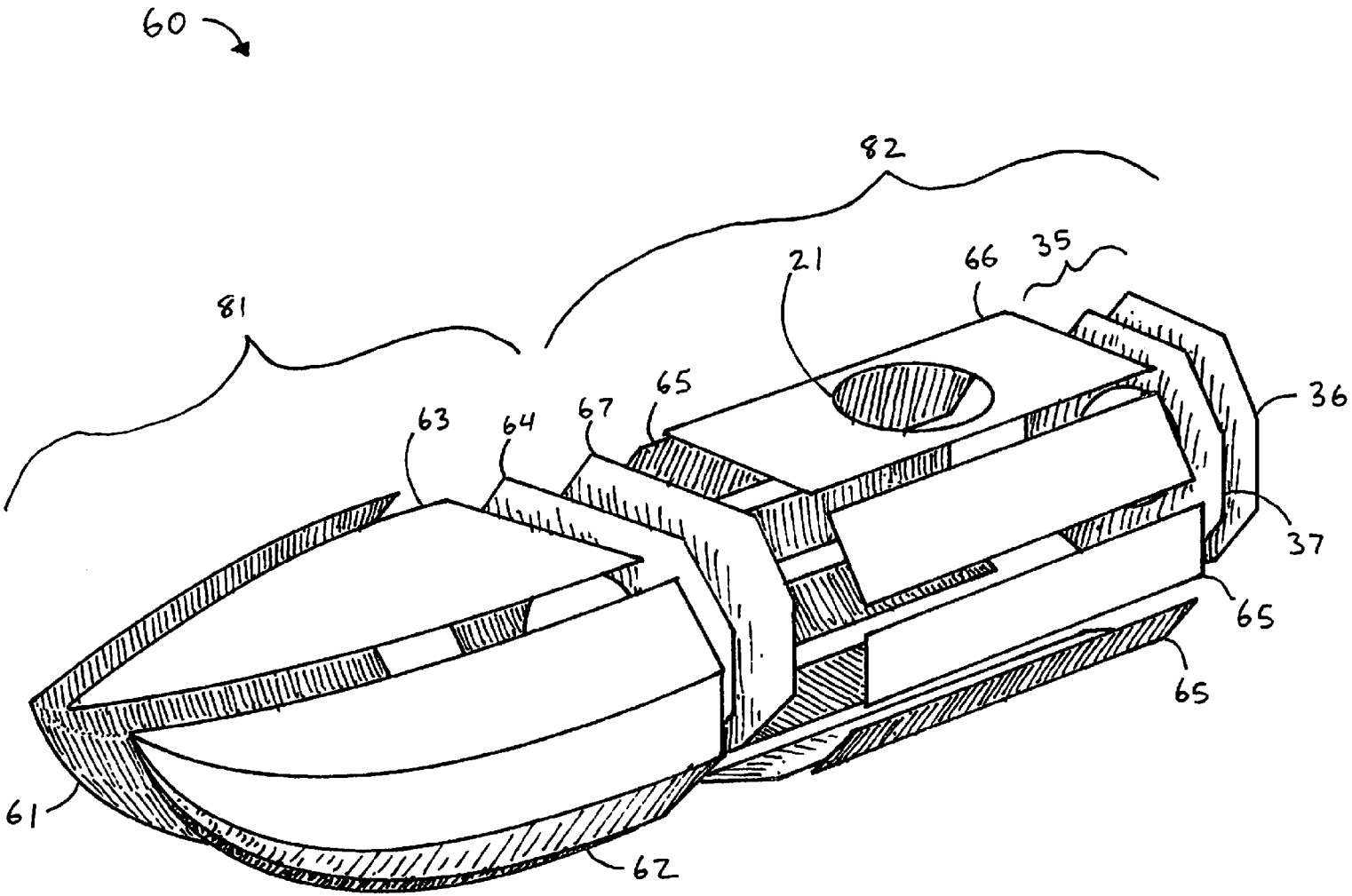
FIG. 7 is an exploded front left perspective view of a hull section in the preferred embodiment.

The sections of a hull 11, 12 are joined together by a watertight joint. To make the joint, a bulkhead 35 is attached to the open ends of each section. As shown in FIG. 7, the bulkhead 35 comprises a disc 36 having a diameter equal to the diameter of the widest part of the hull, and a ring 37 having an outer diameter that fits inside the hull and is flush with the inner surface of the hull. Both the disc 36 and the ring 37 have an outer perimeter that matches the cross-sectional shape of the hull. The ring 37 has an annular surface area that is sufficient to receive a plurality of through-bolts 51. Prefer-ably, the annular surface is between 4.25 and 4.625 inches wide, due to the ring 37 having a circular inner diameter of about 6.5 inches. In an alternative embodiment, the ring 37 is replaced by a second disc that does not have a circular cutout. The alternative second disc may add more stability to the hull, but is also heavier than the ring 37.

The bulkhead 35 is attached using epoxy, fiberglass cloth, or a combination thereof. The outer surface of the bulkhead 35 is subjected to a dead-leveling procedure, so that adjacent bulkheads 35 will abut each other to form a substantially watertight contact when the sections are bolted together. Pref-erably, the dead-leveling is done by hanging the hull section vertically, with the bulkhead 35 facing up, and pouring an epoxy resin onto the bulkhead 35. The resin spreads to a uniform thickness, creating a substantially planar surface. The resin is allowed to dry and then is sanded to a smoother, more planar surface. Additionally, one of the bulkheads 35 in a joint may be coated in a waterproof silicon compound, which will improve the water impermeability of the joint without sticking to the opposing bulkhead 35. It should be noted that only one of the bulkheads 35 in a joint should have the silicon applied to it, as applying the silicon to both bulk-heads 35 will result in fusing of the silicon layers, so that the hull sections will be stuck together.

The hull sections are bolted together at the joints using through-bolts 51 that attach adjacent bulkheads 35. Up to nine through-bolts 51 may be used at each joint, but preferably five through-bolts 51 are used. Once assembled, the joints have a thickness, due to the adjacent bulkheads 35, that adds struc-tural stability to the hulls 11, 12. In the preferred embodiment, the disc 36 and ring 37 are each 0.25 inches thick, resulting in a one-inch thick joint.

In embodiments where the hulls 11, 12 are substantially hollow, each hull 11, 12 may have one or more access ports 21 passing through the deck 34. The access ports 21 allow a user to store articles inside the hull, such as buoyant materials to increase the buoyancy of the catamaran 10, or equipment such as camping or fishing gear. The access ports 21 may also be used to aid in assembling the catamaran 10 by providing additional access to the bulkheads 35 when assembling the hulls 11, 12. Preferably, the access ports 21 are round and slightly smaller in diameter than the width of the deck 34. The preferred access port 21 is reinforced with an insert 22 that receives a lid 23 to make a watertight seal when access is not needed. Most preferably, the insert 22 and lid 23 are com-prised of a BECKSON® screw-out deck plate, and the lid 23 has a 6 inch diameter.

The frame members 13 attach to the left hull 11 and right hull 12, forming a framework on which the platform 14 is placed and defining the width of the catamaran 10. Specifi-cally, the hulls 11, 12 are positioned near the end of the frame members 13, so that the length of the frame members 13 determines how far apart the hulls 11, 12 are. The frame members 13 may be wooden beams having a square cross-sectional shape of 2 to 4 inches. Alternatively, the frame members 13 may be aluminum, fiberglass, or another material capable of supporting the weight of the platform 14, motor, and rider. Preferably, a frame member 13 is comprised of four 4-inch wide wood planks having beveled edges that join together to form a substantially hollow box beam. The wood planks may be 0.375 to 0.5 inches thick. The frame members 13 may be beveled to reduce sharp corners that may harm the rider. The preferred structural integrity of the catamaran 10 is achieved using three frame members 13, attaching to the front, middle, and back of the platform 14 to support and equally distribute the rider's weight. The preferred frame members 13 are 48 inches long and weigh between 8 and 10 pounds. This arrangement supports a single rider. The frame members 13 may be made longer in order to make a wider catamaran 10 that supports more riders. The frame members 13 may attach directly to the deck 34, but preferably a base 41 is positioned between the frame member 13 and each deck 34. The bases 41 serve as shock absorbers, evenly distributing downward force applied to the frame members 13 across the width of the decks 34. The bases 41 are preferably the same width as the frame members 13 and are about 0.75 inches in height. The bases 41 may be free-floating, in that they are held in place by the through-bolt 51 but are not attached to either the frame member 13 or the hull 11, 12. Preferably, however, the bases 41 are attached to the deck 34 using marine epoxy and fiberglass tape. When the bases 41 are permanently attached, the center base 41 is divided into a first half-base 41*a* and a second half-base 41*b* in order to account for the division of each hull 11, 12 into two sections.

The platform 14 is removably attached to the frame members 13, preferably using a plurality of through-bolts 51 that pass from the top surface 42 of the platform 14 through the frame member 13 and the base 41 and into the deck 34. The platform 14 is preferably made of plywood that is about 0.75 inches thick, but may alternatively be a water resistant material that is capable of supporting the rider, such as aluminum or plastic. The platform 14 preferably forms a 48-inch square and is preferably as wide as the frame members 13 are long. The platform 14 may be divided into a plurality of sections. The sections provide ease of transportation when the catamaran 10 is disassembled. Further, the sections distribute the weight of the rider more evenly among the frame members 13 than if the platform 14 were a single piece. Preferably, the platform 14 is divided in half, parallel to the frame members 13. The platform 14 receives the rider, who may stand or sit on the top surface 42 while riding. If desired, the rider may sit in a chair that may be fastened to the platform 14 using attachment points such as the screw eyelets 45 described below. One or more cutouts 43 may be formed into the left or right sides of the platform 14. The cutouts 43 align with the access ports 21 to allow the rider to reach into the access ports 21 while seated or kneeling on the platform 14.

A motor mount 15 may be attached to the front of the platform 14, substantially centered between the hulls 11, 12. Preferably, the motor mount 15 is removably attached with a through-bolt 51 that passes through both the platform 14 and a frame member 13. The motor mount 15 is configured to receive the mounting hardware of an electric motor. The recommended motor is a 12-volt, 30-50 lb. thrust electric trolling motor with a 36 inch shaft, but the motor mount 15 may be substantially universal, in that a comparable electric motor may be attached without modifying the motor mount 15. The motor mount 15 comprises a mount base 52, an angled post 53, a left support 54, a right support 55, a spacer 56, and a shear plate 57. The mount base 52 is flush with the platform 14, except that it may overhang the front of the platform 14 to the front edge of the frame member 13 below. In this case, the spacer 56 is positioned between the mount base 52 and the frame member as shown in FIG. 1. The angled post 53 extends upward and forward from the front of the mount base 52, at an angle $\alpha$ that is obtuse from the mount base 52. See FIG. 3. This allows the motor to be mounted at the end of the angled post 53 and extend vertically downward into the water. Preferably, the angle $\alpha$ is about 110 degrees. The preferred motor and comparable motors are equipped with a clamp that attaches to the angled post 53 to mount the motor. Alternatively, the angled post 53 may be drilled or coated in an adhesive for other attachment types. The mounting position of the motor allows the rider to manipulate the speed and direction of the catamaran 10. Specifically, the motor pulls the catamaran 10 along, as opposed to pushing the craft as with a rear-mounted engine. This gives the rider easy access to controlling the motor. The left support 54 and right support 55 are attached to the mount base 52 and angled post 53 to prevent front-to-back motion of the angled post 53. The supports 54, 55 may be a crossbar or similar rigid support, but preferably are triangular pieces of plywood adhered to the mount base 52 and angled post 53. Similarly, the shear plate 57 is a small crossbar or piece of plywood that attaches to the left support 54 and right support 55 to prevent lateral movement or rotation of the angled post 53. Once mounted, the motor may be attached to a power source, such as a battery or a solar power assembly.

In order to increase the durability, structural stability, and water impermeability of the catamaran 10, each component of the catamaran 10 may have its exterior surface partially or fully coated in an epoxy, fiberglass cloth sheathing, fiberglass tape, or a combination of such products. This treatment gives the components, particularly the hulls 11, 12, a monocoque skin that, together with the plywood construction, gives the catamaran 10 excellent strength and balance in the water with rider, powered components, and other equipment loaded. The monocoque construction may be achieved using any known methods of building watercraft, but the preferred construction method is described below.

Figure 6:
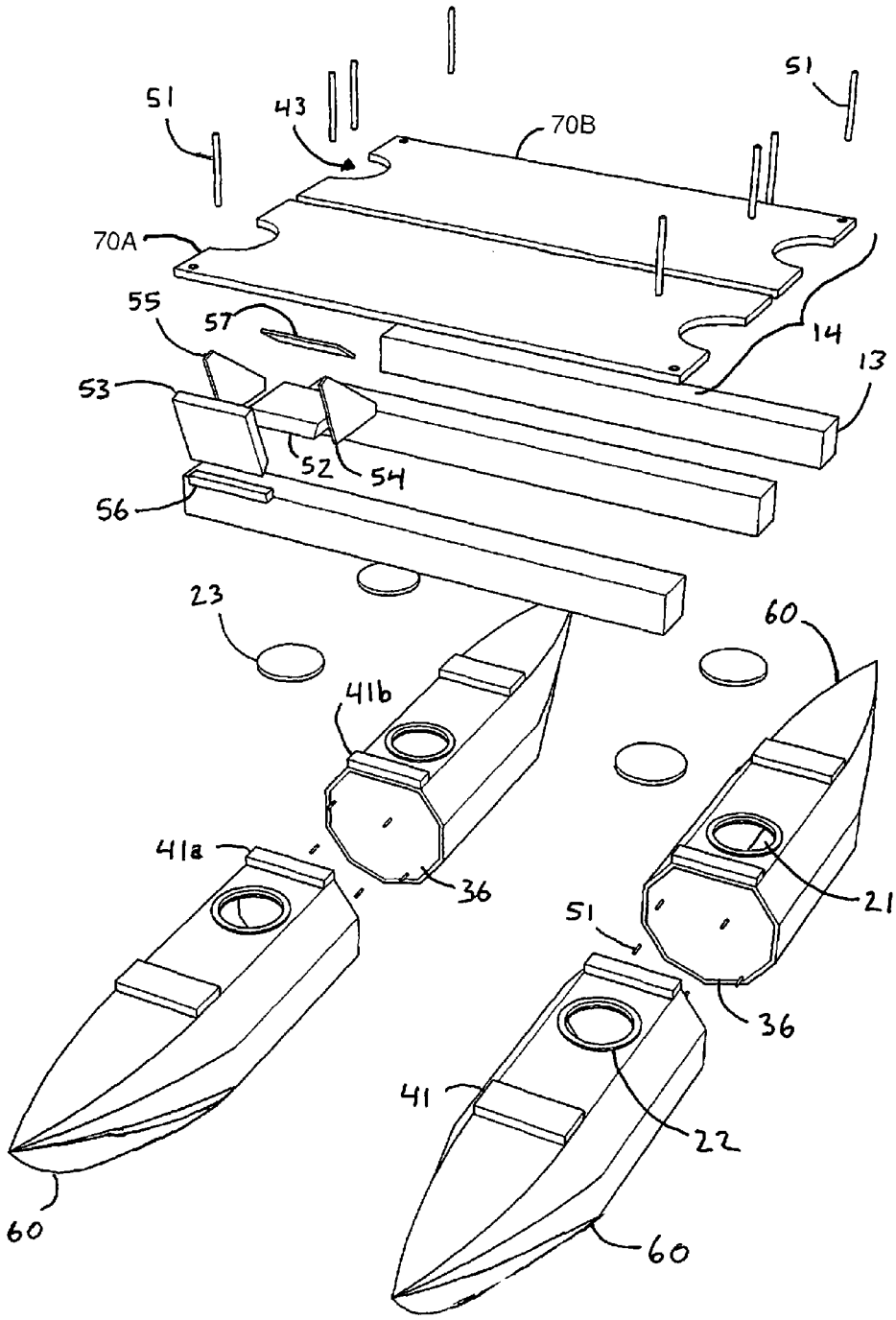
FIG. 6 is an exploded front left perspective view of the catamaran of FIG. 1.
Figure 8:
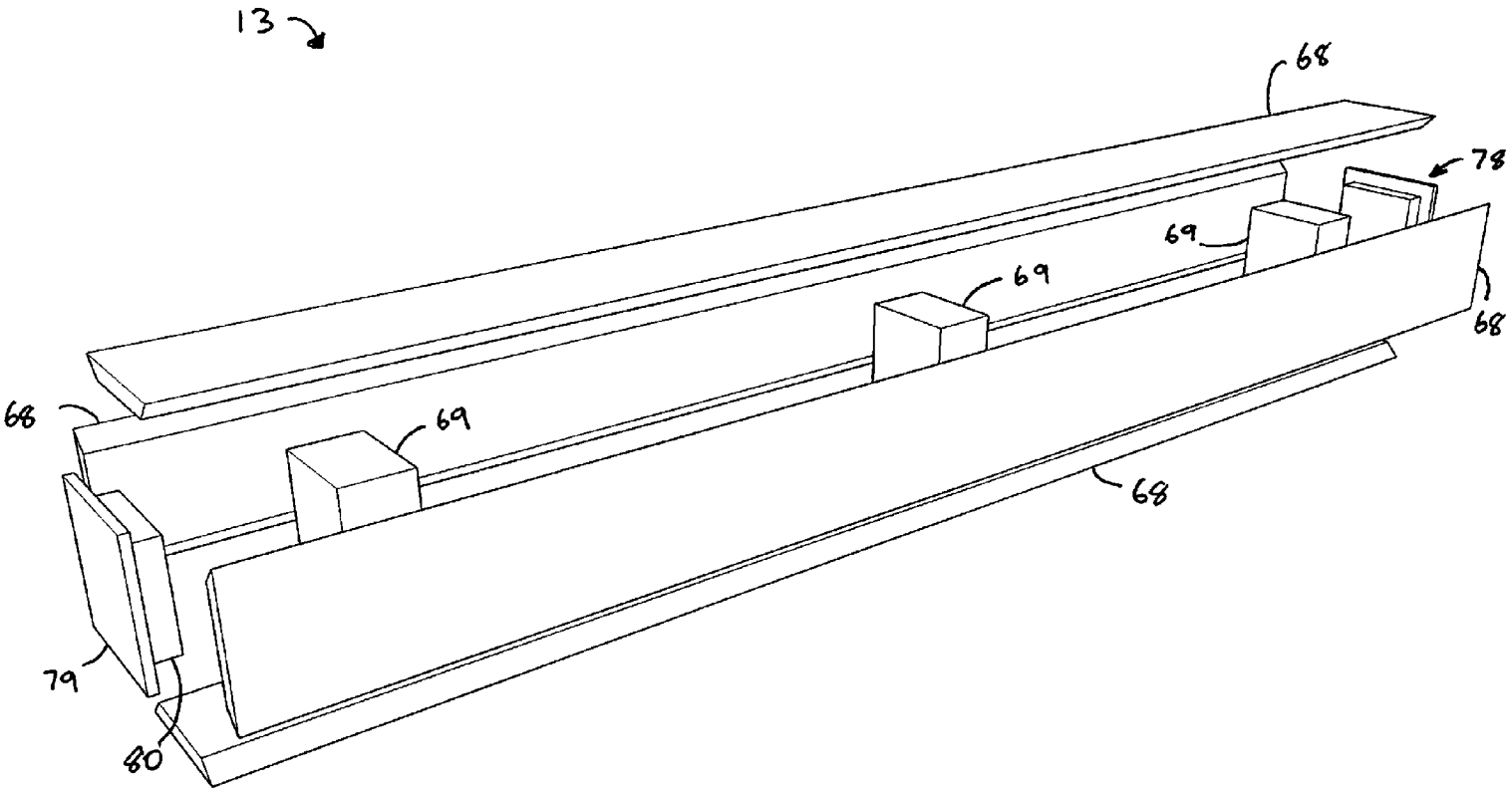
FIG. 8 is an exploded front left perspective view of a frame member in the preferred embodiment.

Referring to FIGS. 6-8, the preferred embodiment of the catamaran 10 is provided to the rider as a kit, so that the rider may construct the catamaran 10 components that will allow him to assemble and disassemble the catamaran 10 before and after each use. The best mode of the kit provides the parts to build the following components, with the understanding that the size of the parts may be scaled up to accommodate a higher weight load or more than one rider:

One left hull 11, 100 inches in length, about 16 inches in width, and about 16 inches in height, divided into two sections of equal length;

One right hull 12, 100 inches in length, about 16 inches in width, and about 16 inches in height, divided into two sections of equal length;

Three frame members 13, measuring 48 inches in length and four inches square in cross-section;

One platform 14, 48 inches square and 0.75 inches thick; and

One motor mount 15.

The components may be provided in various stages of pre-assembly. Preferably, the kit requires significant user assembly, and contains the following parts:

For each hull section 60, as illustrated in FIG. 7: A first shell 61; a second shell 62; a nose deck plank 63; a nose ring 64; eight body planks 65 each 24 inches in length; a body deck plank 66, 24 inches in length, with an access port 21 cut therein; an insert 22; a lid 23; a noseward disc 67; a ring 37; and a disc 36;

Six bases 41, two of which are divided into a first half-base 41*a* and a second half-base 41*b;*

For each frame member 13, as illustrated in FIG. 8: Four beam planks 68 each measuring 48 inches in length, 4 inches in width, and 0.375 inches thick; three rectangular blocks 69 each having a 3.25 inch square cross-sectional shape and a width of about 2 inches; and two end-caps 78 each having a 4 inch square cap 79 attached to a 3.25 inch square sleeve 80, the cap 79 and sleeve 80 each being 0.25 inches thick;

For the platform 14, two platform sections—a front section 70A and a rear section 70B—each comprising half of the platform 14 and, most preferably, weighing about 15 pounds and being separately sheathed in fiberglass cloth and epoxy;

For the motor mount 15, as illustrated in FIG. 6: A mount base 52; an angled post 53; a left support 54; a right support 55; a spacer 56; and a shear plate 57; and 23 through-bolts 51 with nuts.

The kit further may contain gluing, strengthening, and waterproofing materials, or instructions to the builder regarding which materials to use. The preferred catamaran 10 components are assembled using 2-part marine epoxy and silica thickening powder, as well as 6 oz. biaxial-weave fiberglass cloth and 9 oz. fiberglass tape. The preferred application of the marine epoxy and fiberglass cloth, referred to generally below as "gluing," is understood in the field of small watercraft construction. Specifically, to create a permanent, waterproof attachment of parts to each other, "gluing" comprises: applying a sealer coat of epoxy to the wood and allowing it to cure; covering the desired area, which may include one or more parts, with fiberglass cloth and temporarily securing it in place with staples or tape; bonding the cloth to the wood by saturating the cloth with epoxy and smoothing the cloth with a roller, squeegee, or both; allowing the epoxy to cure; and applying a fill coat of epoxy to the desired area and allowing the epoxy to cure. The "desired area" includes the parts that are being attached, waterproofed, or both, and may include both interior and exterior surfaces of the parts. Gluing the components of the preferred catamaran 10 requires about 0.75 gallons of marine epoxy and about 200 square feet of fiberglass cloth. Applying fiberglass tape and silica thickening powder are not steps in the gluing process and are identified separately below. It will be understood that other known methods of watercraft construction may be used in combination with or alternatively to the disclosed methods. Further, because marine epoxy takes time to cure, it will be understood that the gluing steps may include temporarily taping or wiring the parts together to maintain the desired attachment while the epoxy cures. In the preferred embodiment, the epoxy, thickening powder, fiberglass tape, fiberglass cloth, and one or more rollers and squeegees are included in the kit and shipped to the builder in a third box.

Each hull section 60 has a nose module 81 and a body module 82. The nose module 81 is formed by first gluing the first shell 61, second shell 62, and nose deck plank 63 together along their cooperating edges, so that the proximal ends of the first shell 61, second shell 62, and nose deck plank 63 meet to form one of the points of a hull 11, 12, and the distal ends of the first shell 61, second shell 62, and nose deck plank 63 are coplanar and form an open end of the nose module 81. The first shell 61 and second shell 62 are pre-fabricated, in that they are comprised of curved plywood planks glued together and covered by fiberglass cloth in advance of the shells' 61, 62 inclusion in the kit. This is done due to the inherent difficulty of joining the curved planks of a prow, a technique which an ordinary hobbyist likely will not possess. Once the first shell 61, second shell 62, and nose deck plank 63 are attached, the nose ring 64 is glued inside the open end of the nose module 81 so that the outer surface of the nose ring 64 is coplanar with the distal ends of the first shell 61, second shell 62, and nose deck plank 63. This completes the nose module 81. The nose module 81 may then be filled with buoyant material, such as Styrofoam or plastic bottles, through the opening in the nose ring 64. The buoyant material will be retained in the nose module 81, providing positive buoyancy to the bow and stern of each hull 11, 12, even in the event of a hull 11, 12 breach.

The body module 82 is formed by gluing the body planks 65 and body deck plank 66 together lengthwise to form a nonagonal tube, with the body deck plank 66 at the top of the tube. The proximal and distal ends of the body planks 65 and body deck plank 66 are respectively coplanar. Then, the noseward disc 67 is glued inside the proximal end of the tube so that the outer surface of the noseward disc 67 is coplanar with the proximal ends of the body planks 65. Similarly, the ring 37 is glued inside the distal end of the tube, so that the outer surface of the ring 37 is recessed proximally from the distal ends of the body planks 65, at a depth equal to the width of the disc 36. Then, the disc 36 is glued to the ring 37 and the distal ends of the body planks 65 and body deck plank 66. Most preferably, the distal ends of the body planks 65 and body deck plank 66 and the edges of the disc 36 are complementarily beveled so that the outer surface of the disc 36 is coplanar with the distal ends of the body planks 65 and body deck plank 66. To complete the body module 82, the insert 22 is fitted into the access port 21 and attached to the body deck plank 66.

Once the nose module 81 and body module 82 are completed, they are joined together. Preferably, a layer of marine epoxy is applied to the outer surface of either the nose ring 64 or the noseward disc 67 and the modules 81, 82 are pressed together so that the nose deck plank 63 and body deck plank 66 are coplanar. The modules may be temporarily joined by a series of wood screws inserted by reaching into the access port 21. This prevents shifting of the modules 81, 82 while the epoxy cures. After the epoxy has cured, the wood screws are removed. Then, a base 41 is epoxied to the nose deck plank 63 and body deck plank 66, such that the base 41 is centered over the joint between the modules 81, 82. The joint of the base 41 to the deck planks 63, 66 is filleted. Then, 4-inch wide fiberglass tape is applied around the base 41 and the modules 81, 82. Preferably, the fiberglass tape is wrapped twice around, enhancing the structural stability of the hull 11, 12 by absorbing some of the stress applied when a rider steps onto the catamaran 10. The wrapped tape also waterproofs the joint between the modules 81, 82. Either the first half-base 41*a* or second half-base 41*b* of a center base 41 is similarly attached at the distal end of the body module 82, using 2-inch wide fiberglass tape. The hull section 60 may then be sheathed in fiberglass cloth and epoxy to impart a monocoque structure and further waterproof the hull section 60.

The distal end of each hull section 60 then undergoes the dead-leveling procedure described above, with the polyester thickening resin being mixed with the epoxy before application to the distal end. The distal end of the hull section 60 may be wrapped in fiberglass or masking tape so that the tape protrudes beyond the outer surface of the disc 36, creating a dam to stop any overflow of epoxy resin as the resin spreads and settles. Once the resin is cured, the tape is removed and the surface is sanded. Then, a layer of silicon may be applied to the distal ends of two of the hull sections 60 as described above.

Referring to FIG. 8, the beam planks 68 have complementarily beveled edges, so that they may be glued together to form a frame member 13 with a four-inch-square cross-sectional shape. Two of the blocks 69 are positioned inset about 4 inches from the ends of the beam planks 68, and one block 69 is positioned at the center of the beam planks 68, so that the beam planks 68 may be attached to the blocks 69 to form the preferred frame member 13. The beam planks 68 are epoxied to the blocks 69 and glued to each other. Once the beam planks 68 are glued, an end-cap 78 is inserted into each end. The outer surfaces of the sleeve 80 of each end-cap 78 may first be coated in epoxy, so that the sleeve 80 adheres to the beam planks 68. The completed frame member 13 may be sheathed in fiberglass cloth and epoxy. The total weight of the frame member 13 is 10 pounds or less.

The motor mount 15 is assembled as described above and illustrated in FIGS. 1 and 6. As with the other components, the parts of the motor mount 15 may be attached to each other by gluing, and the assembled motor mount 15 may be sheathed in fiberglass cloth and epoxy.

The parts that receive through-bolts 51 may have holes pre-drilled to receive the through-bolts 51. Preferably, however, the holes are not pre-drilled and the kit includes a plurality of drill templates that may be placed on a part or component to indicate the proper location to drill the holes. The catamaran 10 has no component heavier than 17 pounds or longer than 50 inches, so that the components may be transported in the back seat or trunk of most passenger cars. Assembly of the components into the catamaran 10 requires only one or two hand wrenches, which are used to tighten through-bolts 51.

To assemble the preferred components into the catamaran 10, two hull sections 60 are attached together at the bulkhead 35 using five through-bolts 51 to form each hull 11, 12. The assembler may reach through the access ports 21 to install the through-bolts 51 into the joint between the hull sections 60. Once the hulls 11, 12 are assembled, the frame members 13 are then positioned on top of the bases 41, aligning the bolt holes of the hull 11, 12 with those of each base 41 and frame member 13. Once all three frame members 13 are in place, the platform sections 70A, 70B are placed over the frame members 13 and the platform sections' 70A, 70B bolt holes are aligned with the bolt holes of the other parts. A through-bolt 51 is then inserted through each bolt hole, using the access ports 21 to secure the through-bolts 51 into the decks 34 where needed. The motor mount 15 is then affixed to the front of the platform 14 using another through-bolt 51. Then, the motor and power supply may be mounted. To disassemble the catamaran 10, the through-bolts 51 are removed in reverse order.

Referring to FIGS. 9-14, the platform 14 may be configured to receive a cover 16, which may be a Bimini top, a canopy, or another type of cover suitable to provide shade to the rider. The cover 16 comprises a shading member 25 permanently or removably attached to a plurality of support poles 26. The shading member 25 is preferably made of a suitable weatherproof shadecloth, such as canvas, but may alternatively be substantially rigid. The shading member 25 may further provide a surface to which one or more solar panels may be attached. The support poles 26 form a frame over which the shading member 25 extends. The support poles 26 may be wood or a very light-gauge hollow aluminum tube. The support poles 26 may be a fixed or an adjustable length. The adjustability may be achieved using any adjustable-length pole design, such as a telescoping pole. The support poles 26 may be permanently or removably attached to the platform 14 using any suitable attachment mechanism, including a clip, a clamp, a tie-down, or a sheath. Preferably, each corner of the platform 14 has a threaded insert 44 countersunk into the top surface 42. The threaded insert 44 receives a screw eyelet 45 which may be used to tie down one or more of the support poles 26 with rope or a zip-tie. The cover 16 and corresponding attachment hardware may be included in the kit.

Figure 9:
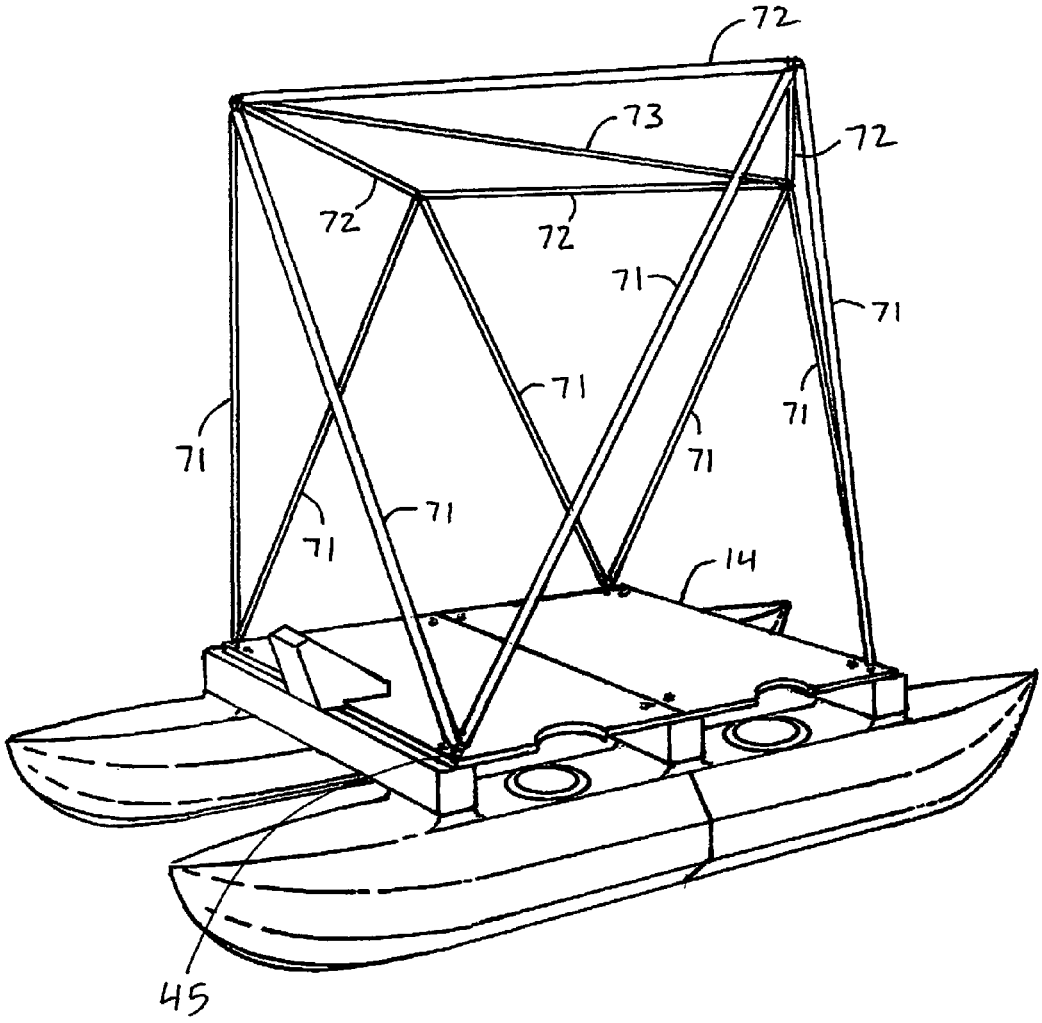
FIG. 9 is a front left perspective view of the preferred catamaran with the preferred support poles assembled thereon.
Figure 10:
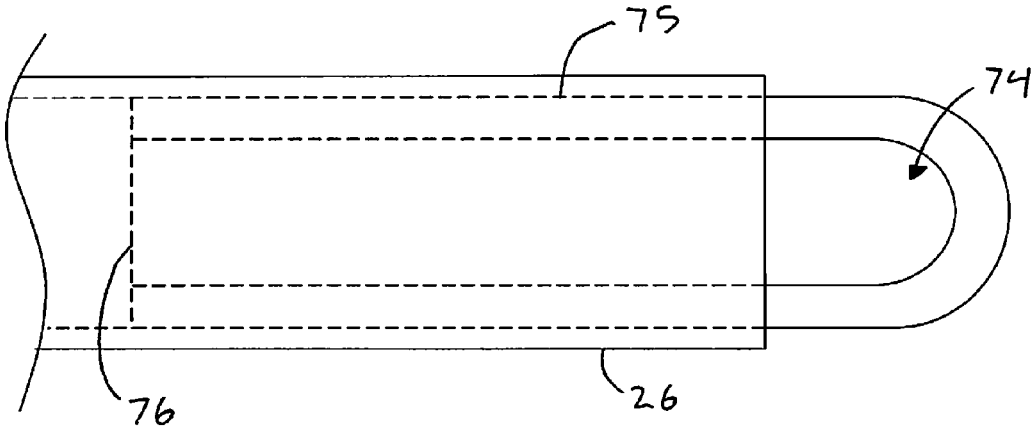
FIG. 10 is a front view of the end of the preferred support pole.
Figure 11:
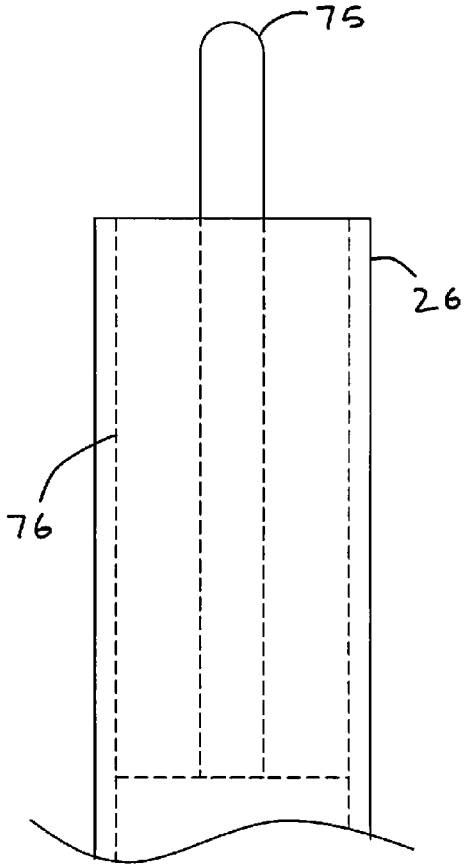
FIG. 11 is a side view of the end of the preferred support pole.

The preferred cover 16 comprises an arrangement of 13 support poles 26 that are attached to the platform 14 and to each other to construct a frame for the shading member 25, as shown in FIG. 9. The support poles 26 include 8 base poles 71, 4 top poles 72, and one diagonal pole 73. To assemble the frame, one end of each base pole 71 is attached to a corner of the platform 14, and the other end is attached to a base pole 71 that is attached to an adjacent corner of the platform 14. The top poles 72 are attached between adjacent junctions of the base poles 71, and the diagonal pole 73 is attached between one set of opposing junctions of the base poles 71. Thus, two base poles 71 will meet at each corner of the platform 14, two base poles 71 and two top poles 72 will meet at each corner of a quadrilateral formed by the top poles 72, and the diagonal pole 73 will meet the base poles 71 and top poles 72 at two opposing corners of the quadrilateral formed by the top poles 72. The frame is made sturdy by the attachment of the diagonal pole 73, and would be susceptible to collapse without it.

The support poles most preferably have a diameter of 0.75 inches. Most preferably, the base poles 71 are each 60 inches long, the top poles 72 are each 48 inches long, and the diagonal pole 73 is 66.75 inches long. These support pole 26 dimensions create a frame that has a 48 inch square at the top, the square being centered directly over the platform 14 but offset by a planar rotation of 45 degrees from the square formed by the platform 14.

Referring to FIGS. 10-13, each support pole 26 has a loop 74 at both ends for attaching the support pole 26 to the platform 14 or other support poles 26. The loop 74 is made from a metal rod 75 having a 0.125 inch radius and being bent into a semicircle. The loop 74 extends about 1 inch out from the end of the support pole 26 and laterally about 2 inches into or along the support pole 26. The loop 74 is used to attach the support pole 26 to the screw eyelet 45 or to the loop 74 of another support pole 26, preferably using wire ties. In the preferred embodiment, shown in FIGS. 10 and 11, the support pole 26 is an aluminum tube having a 0.063 inch thick wall, and the loop 74 has about a 0.188 inch inner radius. To secure the metal rod 75 to the support pole 26, a wooden dowel 76 having two dado slots is coated in epoxy and inserted into the support pole 26. The ends of the metal rod 75 are inserted into the dado slots, and the end of the dowel 76 and support pole 26 are sealed with epoxy. This embodiment of the cover 16 frame weighs about 10 pounds.

Figure 12:
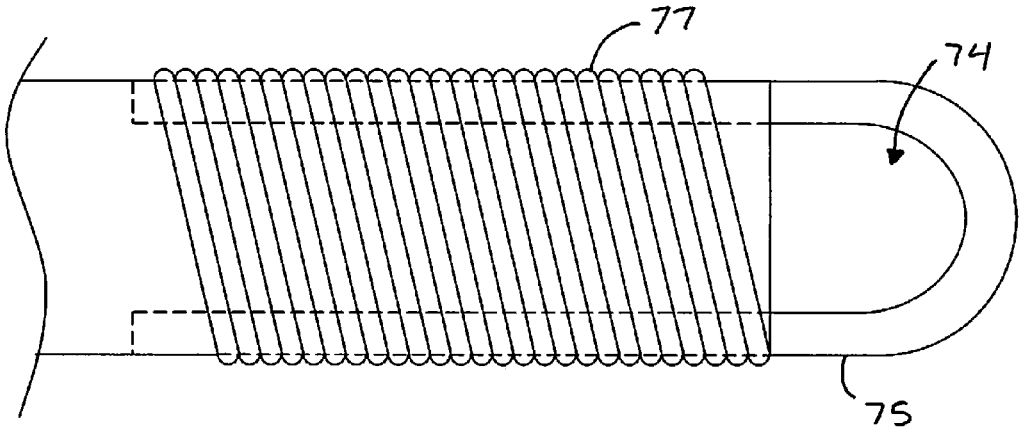
FIG. 12 is a front view of the end of an alternative embodiment of the support pole.
Figure 13:
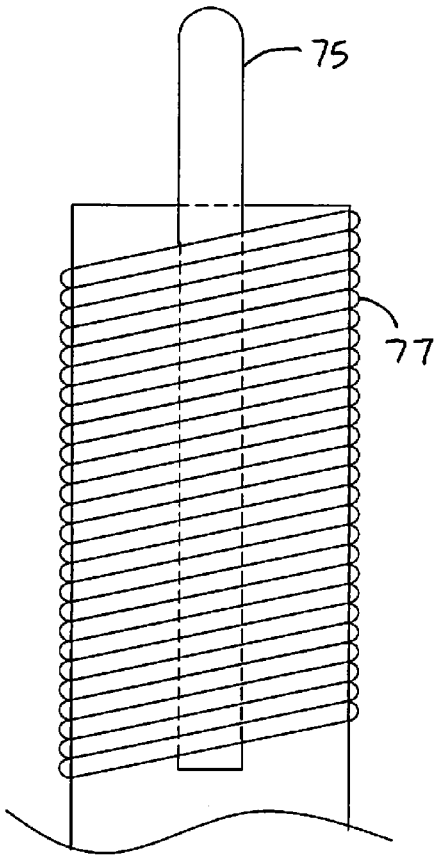
FIG. 13 is a side view of the end of an alternative embodiment of the support pole.
Figure 14:
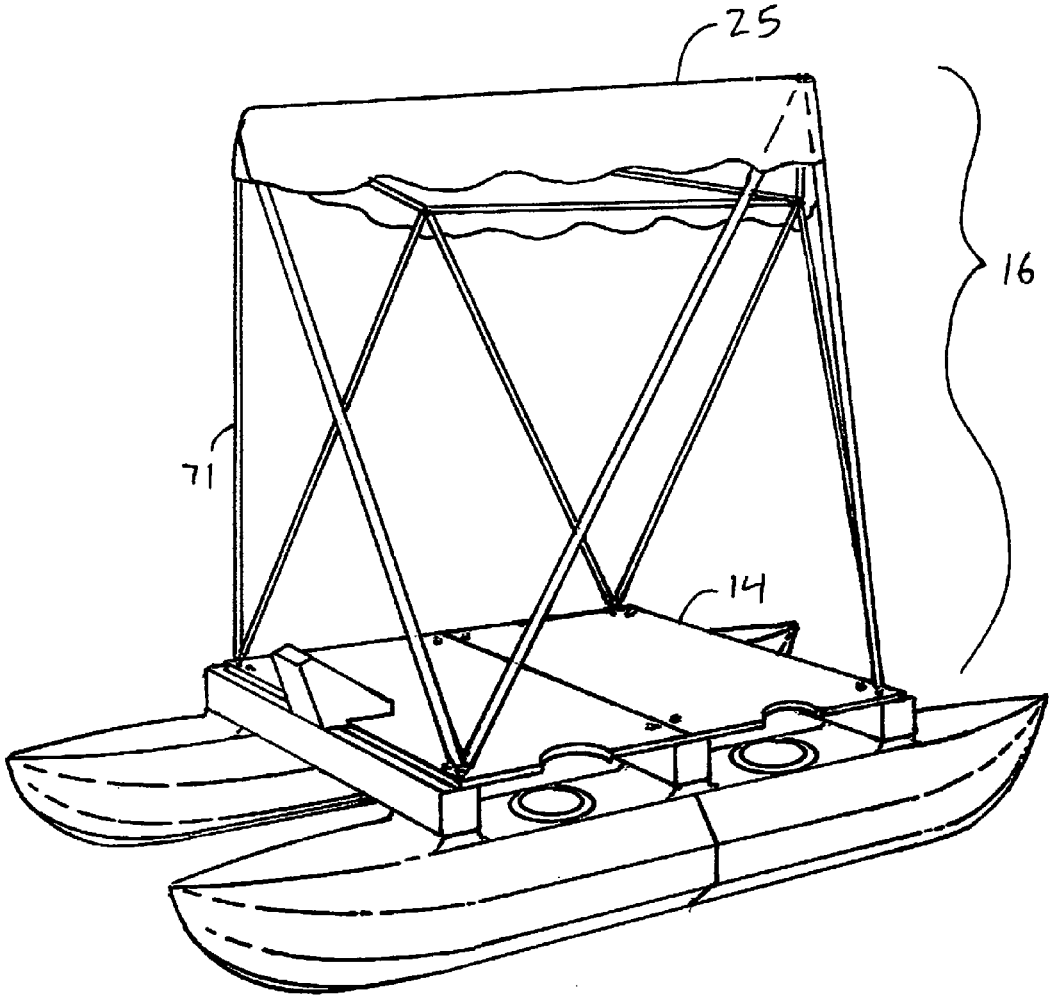
FIG. 14 is a front left perspective view of the preferred catamaran with the preferred cover.

In an alternative embodiment, shown in FIGS. 12 and 13, the support pole 26 is a solid wood pole having diametrically opposed slots, with dimensions of 2 inches long and 0.25 inches wide and deep, on both ends of the support pole 26. The loop 74 has an inner radius of about 0.25 inches. To secure the metal rod 75 to the support pole 26, the ends of the metal rod 75 are coated in epoxy and inserted into the slots. Then, the end of the support pole 26 is wrapped in 0.063 inch thick cotton string 77 or an epoxy-coated copper wire. Finally, the entire support pole 26 is coated in epoxy. This embodiment of the cover 16 frame weighs about 7 pounds.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

I claim:

1. A collapsible catamaran comprising:

a first hull comprising substantially rigid walls and separable first and second sections;

a second hull comprising substantially rigid walls and separable first and second sections;

three substantially rigid frame members removably attached to the first and second hulls, such that the first and second hulls are secured a predetermined distance apart;

a substantially rigid platform removably attached to the frame members, the platform comprising a front section and a rear section separable from the front section; and a motor mount configured to be attached to the front section of the platform wherein the first and second sections of each of the first and second hulls each weigh less than 18 pounds and comprise:

a) a plurality of body planks arranged to form a tube, one of the body planks comprising a body deck plank;

b) a noseward disc attached to the body planks at the proximal end;

c) an access port disposed through the body deck plank;

d) a first shell;

e) a second shell attached to the first shell;

f) a nose deck plank attached to the first shell and the second shell such that the distal ends of the first shell, the second shell, and the nose deck plank are aligned with the proximal ends of the body planks of the body module, the nose deck plank being aligned with the body deck plank;

g) a nose ring attached to the noseward disc and to the first shell, the second shell, and the nose deck plank at the distal ends of the first shell, the second shell, and the nose deck plank;

h) a base attached to the nose deck plank at the distal end of the nose deck plank, and to the body deck plank at the proximal end of the body deck plank, the base being configured to receive an end of one of the frame members;

i) a half-base attached to the body deck plank at the distal end of the body deck plank, such that the half-base of the first section of each hull cooperates with the half-base of the second section of the same hull to receive an end of one of the frame members; and j) a bulkhead attached to the body planks at the distal end of the body planks, wherein the bulkhead of each of the first sections abuts the bulkhead of one of the second sections to form a watertight joint;

wherein, for each hull, the first section may be attached to and detached from the second section using a plurality of through-bolts disposed through the bulkhead of each section.

2. The collapsible catamaran of claim 1 wherein each frame member weighs less than 10 pounds and comprises:

a) a plurality of blocks;

b) four beam planks attached to the blocks to form a substantially hollow box beam having a proximal end and a distal end; and c) two end-caps attached to the proximal and distal ends of the box beam.

3. The collapsible catamaran of claim 2 wherein:

a) each hull is about 100 inches long and about 16 inches wide;

b) each frame member is about 48 inches long, about 4 inches wide, and about 4 inches high; and c) the first and second sections of each hull, the frame members, the front and rear sections of the platform, and the motor mount together fit into a space of about 32 cubic feet when the catamaran is collapsed.

* * * * *